US008087759B2

(12) United States Patent
Oikawa et al.

(10) Patent No.: US 8,087,759 B2
(45) Date of Patent: Jan. 3, 2012

(54) PRINT HEAD WITH OFFSET EJECTION PORTS

(75) Inventors: Masaki Oikawa, Inagi (JP); Keiji Tomizawa, Yokohama (JP); Mikiya Umeyama, Tokyo (JP); Toru Yamane, Yokohama (JP); Yuichiro Akama, Tokyo (JP); Chiaki Muraoka, Kawaguchi (JP); Tomotsugu Kuroda, Kawasaki (JP); Shingo Nagata, Kawasaki (JP); Satoshi Kudo, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 296 days.

(21) Appl. No.: 12/485,997

(22) Filed: Jun. 17, 2009

(65) Prior Publication Data

US 2009/0315945 A1 Dec. 24, 2009

(30) Foreign Application Priority Data

Jun. 19, 2008 (JP) ..... 2008-160365

(51) Int. Cl.
*B41J 2/05* (2006.01)

(52) U.S. Cl. ..... 347/65; 347/56; 347/63

(58) Field of Classification Search ..... 347/20, 347/44, 47, 56, 61–65, 67, 92–94
See application file for complete search history.

(56) References Cited

U.S. PATENT DOCUMENTS

| | | | | |
|---|---|---|---|---|
| 5,218,376 | A | 6/1993 | Asai | |
| 5,608,436 | A * | 3/1997 | Baughman et al. | 347/65 |
| 6,155,673 | A | 12/2000 | Nakajima et al. | |
| 6,443,564 | B1 * | 9/2002 | Keil et al. | 347/65 |
| 6,652,079 | B2 | 11/2003 | Tsuchii et al. | |
| 6,830,317 | B2 * | 12/2004 | Tsuchii et al. | 347/56 |
| 6,966,634 | B2 * | 11/2005 | Hsu et al. | 347/63 |
| 6,984,025 | B2 | 1/2006 | Kaneko et al. | |
| 6,988,786 | B2 | 1/2006 | Kaneko et al. | |
| 7,108,352 | B2 | 9/2006 | Muraoka | |
| 2006/0232637 | A1 | 10/2006 | Matsui et al. | |
| 2008/0055368 | A1 | 3/2008 | Oikawa et al. | |
| 2008/0252698 | A1 | 10/2008 | Kudo et al. | |
| 2009/0058949 | A1 | 3/2009 | Tomizawa et al. | |
| 2009/0147056 | A1 | 6/2009 | Oikawa et al. | |
| 2009/0147057 | A1 | 6/2009 | Oikawa et al. | |
| 2010/0045719 | A1 | 2/2010 | Akama et al. | |
| 2010/0053277 | A1 | 3/2010 | Matsumoto et al. | |

FOREIGN PATENT DOCUMENTS

| | | |
|---|---|---|
| JP | 4-10941 | 1/1992 |
| JP | 2003-311964 | 11/2003 |
| JP | 2005-1379 | 1/2005 |
| JP | 2006-315395 | 11/2006 |

* cited by examiner

*Primary Examiner* — Juanita D Stephens
(74) *Attorney, Agent, or Firm* — Fitzpatrick, Cella, Harper & Scinto

(57) ABSTRACT

The impact accuracy of ejected droplets, the quality of printed images, and print speed can be improved in a print head having an ink channel for which the width thereof in a direction orthogonal to an ink supply direction in which ink is supplied from an ink supply port to a pressure chamber is smaller than that of a pressure chamber. In the print head, the center of a heater along the ink supply direction is offset from the center of the pressure chamber along the ink supply direction, toward the side of the pressure chamber far from the ink supply port in the ink supply direction.

5 Claims, 12 Drawing Sheets

PRINT HEAD WITH OFFSET EJECTION PORTS

BACKGROUND OF THE INVENTION

1. Field of the Invention

The present invention relates to a print head that ejects a liquid onto a print medium.

2. Description of the Related Art

In recent years, ink jet printing apparatuses have been prevailing rapidly in which a print head is located opposite a print medium to eject ink droplets onto the print medium for printing. The ink jet printing apparatuses have the advantages of being easily miniaturized and being able to relatively easily perform color printing. An ink jet printing apparatus is disclosed in, for example, Japanese Patent Laid-Open No. H04-10941 (1992). Such an ink jet printing apparatus uses any of various techniques for improving the quality of images resulting from printing.

When the ink jet printing apparatus is used for printing, a dot density control method can be used for printing; the dot density control method controls the number of print dots of a given size provided per unit area in order to express an intermediate gray level. For such control means, a printing method has been proposed which uses nozzles for ink droplets of different sizes so that smaller ink droplets are used to form print dots for the range from a bright portion to an intermediate gray level portion of the image, whereas larger ink droplets are used to form print dots for the range from the intermediate gray level portion to a dark portion of the image.

For example, Japanese Patent Laid-Open No. 2003-311964 discloses an ink jet printing apparatus using, for printing, a print head in which ejection ports involving ejected droplets of different flow rates are formed, as described above. The print head in such an ink jet printing apparatus is known to have plural types of ejection ports formed therein under different conditions; the diameter of the ejection port, the sectional area of an ink channel, and flow resistance in the print head vary among the ejection ports. This enables plural types of droplets to be ejected.

On the other hand, there has been a demand for improvement of the quality of images provided by the ink jet printing apparatus. Efforts have been made to reduce the size of droplets ejected during printing. However, when droplets of a reduced size are ejected, as is, a reduced amount of droplets are ejected, preventing supplying of an amount of droplets required per unit area sufficiently. Thus, when the diameter of the ejection ports is reduced to decrease the size of the droplets, nozzle row resolution correspondingly needs to be increased. However, the increase in nozzle row resolution is limited. In general, a further reduction in the size of the droplets ejected is known to reduce ejection efficiency with respect to the droplet ejected. Furthermore, as nozzle density is increased to improve the nozzle resolution, the size of heaters more significantly affects the nozzle resolution in connection with the array of the nozzles. With a further increase in nozzle density, the array of the nozzles is affected by the size of the heaters per se. Then, that makes it difficult to connect between wiring and the heaters. Finally, the heaters cannot be arranged in a line. This applies not only to the heaters but also to the channels though which ink is fed. It is regarded as the size of the ink channel per se prevents an increase in nozzle density.

Thus, an invention has been disclosed in which heaters are alternately staggered and a plurality of ejection ports with different dot diameters are also staggeredly arranged as disclosed in Japanese Patent Laid-Open No. 2005-1379.

An invention has also been disclosed in which heaters are alternately staggered with the flow resistance of flow channels improved as disclosed in Japanese Patent Laid-Open No. 2006-315395.

However, in spite of these measures, the quality of images resulting from printing may be degraded.

For example, in print heads in some ink jet printing apparatuses, ink supplied to an ink supply port is fed to a common liquid chamber. The ink is then fed, via ink channels, to pressure chambers inside which respective print elements are arranged. In this case, the print head adopted may be of a type in which the channel width in the pressure chamber is larger than that in the ink channel. In this manner, the ink channels, each extending between the corresponding pressure chamber and common liquid chamber in the print head, have a relatively small channel width. This enables an increase in the flow resistance of ink stored inside the ink channel, preventing movement of the ink in the ink channel. Since the ink in the ink channel has difficulty moving, when an energy generating element is driven inside the pressure chamber, the resulting bubbling energy is inhibited from escaping toward the common liquid chamber. As a result, most of the energy generated by the energy generating element is used to eject the ink. The ink is thus efficiently ejected.

However, when the ink channel has a smaller channel width than the pressure chamber, a wall surface is formed at the boundary between the pressure chamber and the ink channel toward the interior of the channel. Then, a bubble generated during driving of the energy generating element may come into contact with the ink supply port side of the wall surface of the pressure chamber. Upon coming into contact with this side of the wall surface, the bubble may be deformed and become asymmetric. Thus, the shape of the bubble may become disproportionate, preventing the ink from being ejected straight.

If the ink fails to be ejected straight as described above, a trailing portion of the ink may be partly torn away and separated from the main droplet to form a sub-droplet (satellite droplet). In general, in the ink jet printing apparatus, when the print head ejects the ink, the ejected droplet is divided into the main droplet and the trailing sub-droplet called the satellite droplet. The satellite droplet thus generated flies in a direction different from that of the main droplet. As is known, the satellite droplet impacting a print medium may affect the granular property of a printed image. Dot density may then be varied to cause an uneven density, stripes, or the like at a scan boundary. The printed image is thus affected.

At present, to prevent the impact position deviation from affecting the printed image, the speed of a carriage is reduced to substantially mitigate the adverse effect of the satellite droplet. Furthermore, the number of passes of the multipass printing during scanning is reduced to decrease print speed. However, to increase the print speed with the high quality of the printed image maintained, the impact accuracy not only of the main droplet but also of the satellite droplet needs to be improved.

Also disadvantageously, if the size of satellite droplets continues to decrease in connection with the recent decrease in the size of ejected droplets, the satellite droplets fly in and around the printing apparatus and may adhere to the apparatus. The satellite droplets adhering to the printing apparatus disadvantageously contaminate the interior of the apparatus.

SUMMARY OF THE INVENTION

The present invention has been made in view of the above-described problems. An object of the present invention is to, in response to a demand for improvement of image quality and print speed, improve the impact accuracy of ejected droplets to increase the quality of printed images and the print speed.

According to an aspect of the present invention, there is provided a print head comprising a nozzle, the nozzle comprising: a pressure chamber in which a liquid supplied from a liquid supply port is stored; a print element located in the pressure chamber to generate energy to be applied to the liquid stored in the pressure chamber; an ejection port communicating with the pressure chamber and allowing the liquid with the energy applied thereto by the print element to be ejected; and a liquid channel through which the liquid to be supplied from the liquid supply port to the pressure chamber flows, the liquid channel having a width in a direction orthogonal to a liquid supply direction in which the liquid is supplied from the liquid supply port to the pressure chamber, the width of the liquid channel being smaller than that of the pressure chamber in the direction orthogonal to the liquid supply direction, wherein a center of the print element along the liquid supply direction is located offset from a center of the pressure chamber along the liquid supply direction, toward a distal side of the pressure chamber far from the liquid supply port in the liquid supply direction.

According to the present invention, when the print head ejects droplets, a bubble generated by the print element is inhibited from being deformed during the ejection of the droplet. Thus, the ejected droplet is prevented from being affected by the deformation of the bubble. Consequently, the droplet can be accurately ejected to a predetermined position.

Further features of the present invention will become apparent from the following description of exemplary embodiments (with reference to the attached drawings).

DESCRIPTION OF THE EMBODIMENTS

First Embodiment

A first embodiment of the present invention will be described below in detail with reference to the accompanying drawings.

<General Description of the Apparatus Main Body>

Figure 1:
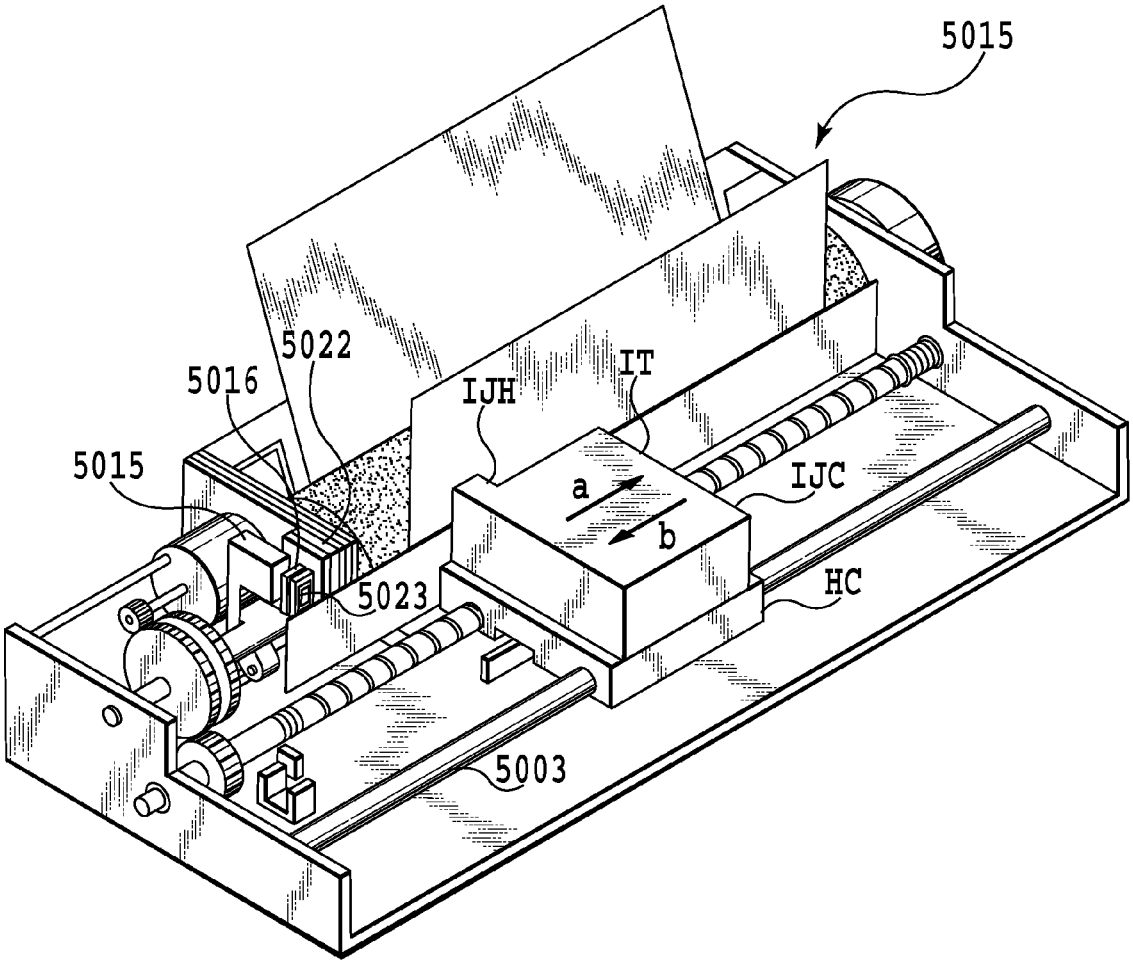
FIG. 1 is a perspective view of a printing apparatus with a print head mounted therein according to a first embodiment of the present invention.

FIG. 1 is a perspective view of an ink jet printing apparatus IJRA using a print head as an ink jet print head according to an embodiment of the present invention. The ink jet printing apparatus IJRA shown in FIG. 1 includes a carriage HC. An ink jet cartridge IJC is mounted on a carriage HC. In the present embodiment, the ink jet cartridge IJC contains a print head IJH and an ink tank IT which are integrated together. Though, in the present embodiment, the ink jet cartridge IJC contains the print head IJH and ink tank IT integrated together, but the present invention is not limited to this aspect. The print head IJH and the ink tank IT may be formed to be separable so as to be assembled together before use. The carriage HC is supported on a guide rail 5003 so as to be movable in a direction in which the guide rail 5003 extends. For printing, the carriage HC ejects droplets to a print medium while reciprocating along the guide rail 5003 in the directions of arrows (a) and (b) in FIG. 1.

Reference numeral 5016 denotes a member supporting a cap member 5022 that caps the front surface of the print head IJH. Reference numeral 5015 denotes a suction member that subjects the interior of the cap to suction. When the suction and recovery member performs suction and recovery on the print head IJH, the cap member 5022 caps ejection ports in the print head IJH. Then, a suction and recovery operation is performed on the print head via a cap opening 5023.

<Description of the Control Arrangement>

Now, a control arrangement for controlling printing performed by the above-described ink jet printing apparatus IJRA will be described.

Figure 2:
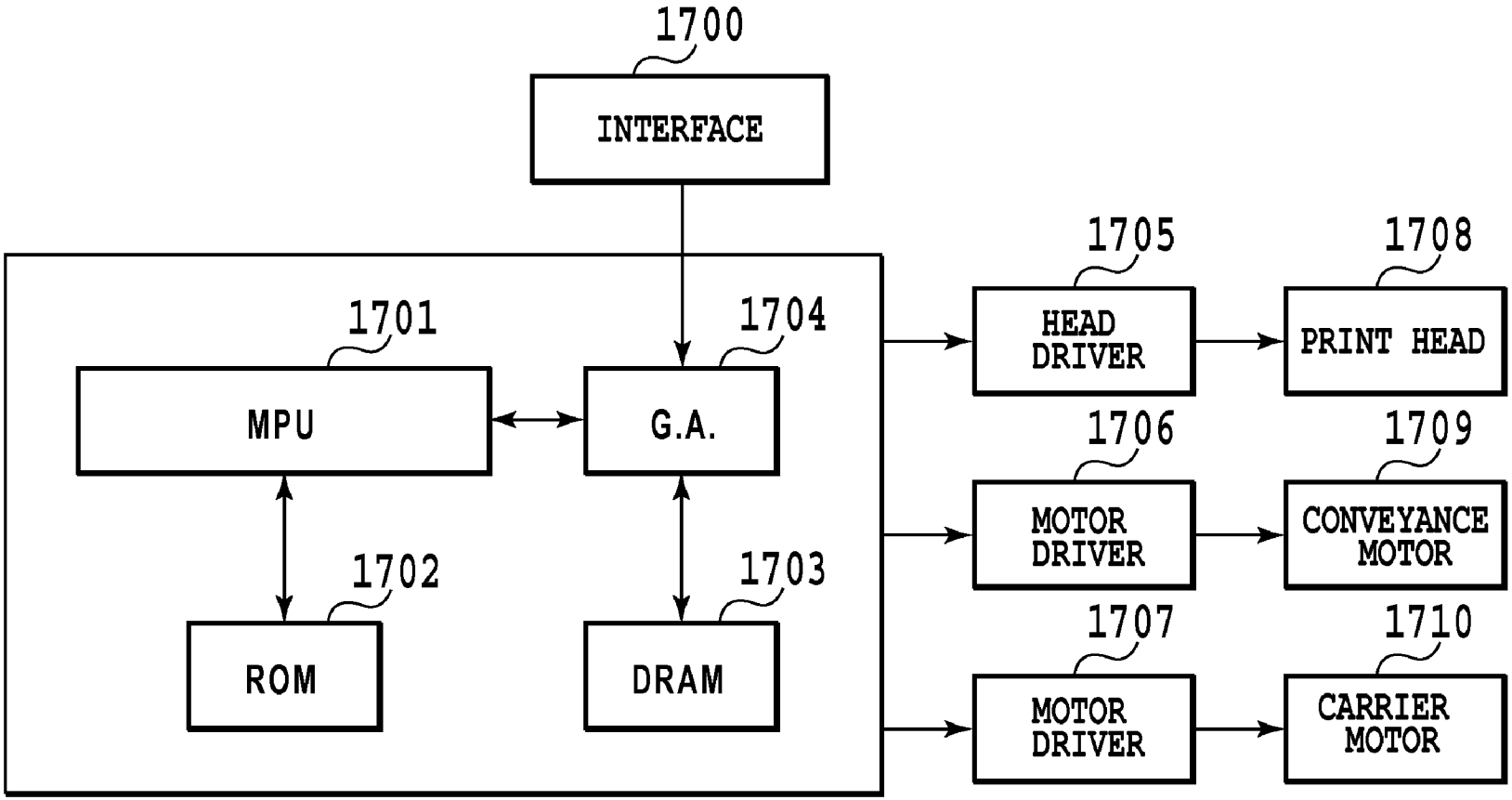
FIG. 2 is a block diagram showing the configuration of a printing system in the printing apparatus in FIG. 1.

FIG. 2 is a block diagram showing the configuration of a control circuit for the ink jet printing apparatus IJRA. Hereinafter, a performance of the control arrangement will be described. First, a print signal input to an interface 1700 is converted into print data for printing at the portion between a gate array 1704 and an MPU 1701. Then, motor drivers 1706 and 1707 are driven, and the print head IJH is driven according to the print data sent to a head driver 1705. Printing is thus performed.

<Description of the Configuration of the Print Head>

Now, the ink jet print head IJH according to the present invention will be described.

The print head IJH as an ink jet print head according to the present embodiment includes heaters as print elements corresponding to means for generating heat energy as energy utilized to eject ink as a liquid. The resulting heat energy is used to cause film boiling inside the ink. This induces a phase change in the ink. Then, bubbles generated by the film boiling apply kinetic energy to the ink to eject the ink through the ejection ports. The print head IJH according to the present embodiment uses this scheme to increase the density and definition of printed texts, images, and the like.

Figure 3:
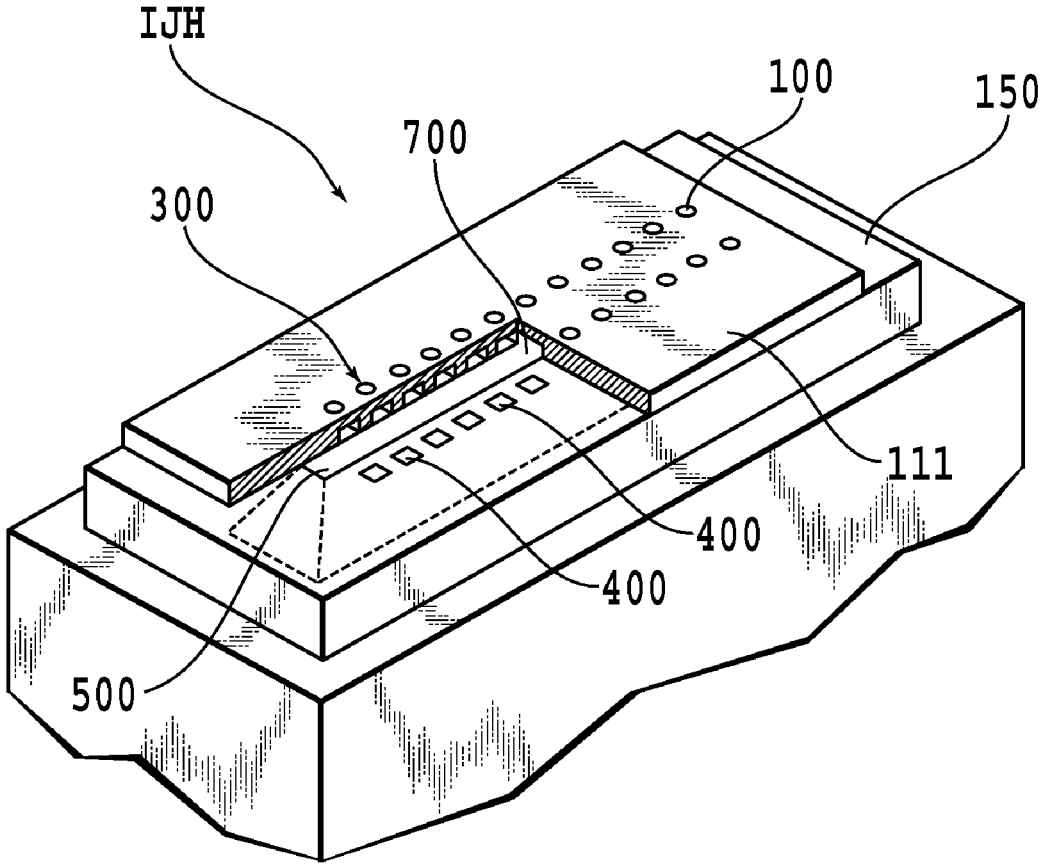
FIG. 3 is a partly exploded perspective view showing the structure of a print head in the printing apparatus in FIG. 1.

The general configuration of the ink jet print head according to the present embodiment will be described. FIG. 3 is a partly exploded perspective view of the print head IJH according to the present embodiment, showing a part of the internal structure of the print head IJH. In the print head IJH according to the present embodiment, an element substrate 150 and a channel forming member 111 are joined together. The element substrate 150 includes a plurality of heaters 400 as print elements. Channels for plural types of ink are formed in the channel forming member 111 and joined together on a main surface of the element substrate 150 in a stack.

The element substrate 150 is formed of Si. The element substrate 150 may be formed of a material other than Si, for example, glass, ceramics, resin, or metal. The heaters 400, electrodes (not shown in the drawings), and wires (not shown in the drawings) are formed on the main surface of the element substrate 150 for the channels for the respective types of ink corresponding to respective nozzles; the electrodes apply voltages to the heaters 400, and the wires are connected to the electrodes in a predetermined wiring pattern. An insulating film (not shown in the drawings) improving the divergence property of accumulated heat is provided on the main surface of the element substrate 150 so as to cover the heaters 400. A protective film (not shown in the drawings) protecting the heaters 400 from cavitation resulting from debubbling is provided on the main surface of the element substrate 150 so as to cover the insulating film.

As shown in FIG. 3, the channel forming member 111 has a plurality of nozzles 300 through which ink flows, and an ink supply port 500 from which the ink is fed to the nozzles 300. A common liquid chamber 700 is formed between the ink supply port 500 and the nozzles 300. Each of the nozzles 300 has a plurality of ejection ports 100 that are openings at an end portion of the nozzle. The ejection ports 100 are formed at positions on the element substrate 150 which correspond to the heaters 400.

As shown in FIG. 3, the print head IJH has the plurality of heaters 400 and the plurality of nozzles 300 on the element substrate. The plurality of nozzles 300 is arranged so as to configure two nozzle rows arranged in a direction parallel to the extending direction of the ink supply port 500. The nozzle rows are positioned on the both sides of the ink supply port 500 as the nozzle rows sandwiches the ink supply port 500. The nozzle rows are formed such that the adjacent nozzles are arranged at a pitch of 600 dpi to 1,200 dpi. In the present embodiment, the pitch between the adjacent nozzles in one of the nozzle rows is offset from the pitch between the corresponding adjacent nozzles in the other nozzle row by an amount corresponding to a half pitch. Thus, the two nozzle rows with the ink supply port 500 sandwiched therebetween are staggered.

A nozzle structure corresponding to the main part of the print head IJH according to the present embodiment will be described below.

Figure 4A:
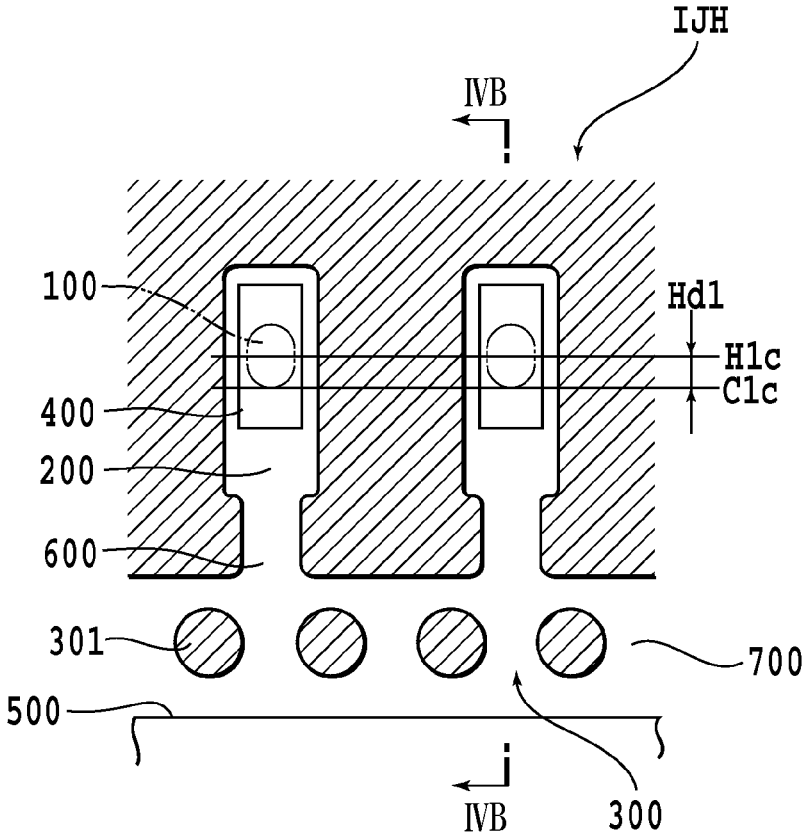
FIG. 4A is a sectional view showing the internal structure of an essential part of the print head in FIG. 3 as viewed in an ejection direction.
Figure 4B:
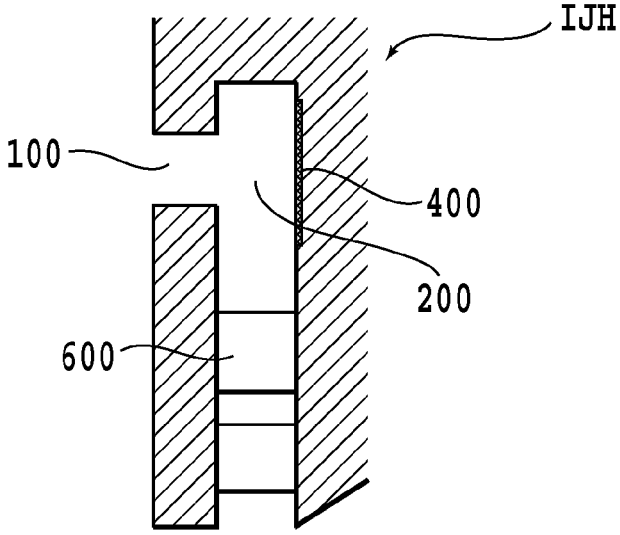
FIG. 4B is a sectional view taken along line IVB-IVB in FIG. 4A.

FIG. 4A is a sectional view of the nozzle structure of the print head IJH according to the present embodiment, showing the interior of the nozzle as viewed from the direction in which droplets are ejected. FIG. 4B is a sectional view taken along line IVB-IVB in FIG. 4A, showing one of the plurality of nozzles in the print head IJH.

The nozzle 300 in the print head IJH according to the present embodiment has the pressure chamber 200, the heaters 400 as print elements, the ejection ports 100, and ink channels 600 as liquid channels. The pressure chamber 200 internally stores the ink as a liquid fed from the ink supply port 500 as a liquid supply port, for printing. Each of the heaters 400 is located inside the corresponding pressure chamber 200 to generate energy to be applied to the ink stored in the pressure chamber 200. In the present embodiment, the heater 400 converts electric energy into heat energy to generate heat to be applied to the ink. Each of the ejection ports 100 is formed in communication with the corresponding pressure chamber 200. The ink to which the energy is applied by the heater 400 is ejected onto a print medium through the ejection port 100.

In the nozzle 300, the ink channel 600 is formed between the pressure chamber 200 and the common liquid chamber 700 formed around the periphery of the ink supply port 500. The ink to be fed from the ink supply port 500 to the interior of the pressure chamber 200 passes through the ink channel 600. In a direction orthogonal to the ink supply direction, the width of the ink channel 600 is smaller than that of the pressure chamber 200. Here, the ink supply direction as a liquid supply direction refers to the direction in which the ink is fed from the ink supply port 500 to the pressure chamber 200.

The ink channel 600 in the nozzle 300 is formed as described above. Thus, one end of the ink channel 600 communicates with the pressure chamber 200. The other end of the ink channel 600 communicates with the common liquid chamber located around the periphery of the ink supply port 500. At the boundary between the pressure chamber 200 and the nozzle 300, the channel width in the nozzle row direction changes, that is, the channel width in the direction orthogonal to the ink supply direction is larger.

As shown in FIG. 4B, in the present embodiment, the heater 400 is located inside the pressure chamber 200. The ejection port 100 is formed to communicate with the pressure chamber 200. The nozzle 300 is formed such that the ejection direction in which the ink is ejected from the ejection port 100 is orthogonal to the ink supply direction in which the ink is fed from the ink supply port 500 to the pressure chamber 200.

Now, the dimensions of the components according to the present embodiment will be described with reference to FIGS. 4A and 4B. In the present embodiment, the nozzle pitch in the direction in which the ejection ports in the nozzle row are arranged is 42.3 μm (600 dpi). The heater 400 has a rectangular shape of 12 μm×28 μm and has an aspect ratio of at most 1/2. The ejection port 100 has an oval shape with a minor axis of 10 μm and a major axis of 12.5 μm. The ejection port 100 has a depth of 11 μm and an ejection amount of about 2 pl. The pressure chamber 200 has a width of 19 μm in the nozzle row direction and a length of 45 μm in the ink supply direction. The clearance between the edge of the heater 400 and the wall located at the farthest place from ink supply port 500 in the pressure chamber 200 and the clearance between the edge of the heater 400 and the side wall of the pressure chamber 200 are both about 3.5 μm. The clearance between the ink supply port-side end of the heater 400 and the ink supply port-side wall of the pressure chamber is 13.5 μm. The ink channel 600 is 11 μm in width, 15.5 μm in length, and 14 μm in height.

In the print head IJH according to the present embodiment, the center of the heater 400 along the ink supply direction is located offset from the center of the pressure chamber 200 along the ink supply direction, toward the side of the pressure chamber 200 far from the ink supply port in the ink supply direction.

As shown in FIG. 4A, in the present embodiment, the heater 400 is located such that the center H1*c* of the heater 400 along the ink supply direction is offset from the center C1*c* of the pressure chamber 200 along the ink supply direction by 5 μm. The heater 400 is not located in an area in the pressure chamber 200 which is closer to the ink supply port. A relatively large space not associated with the generation of bubbles is located in this area.

With reference to FIGS. 5A, 5B, 6A, and 6B, description will be given of the effect of the offset of the center of the heater 400 toward the side far from the ink supply port in the ink supply direction from the center C1*c* of the pressure chamber 200 along the ink supply direction.

Figure 5A:
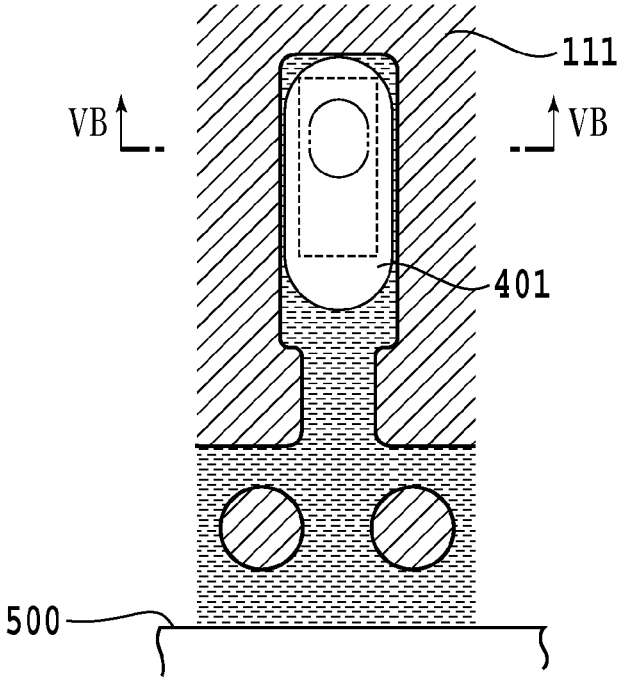
FIG. 5A is a sectional view showing the internal structure of the print head to which the present invention is applied, as viewed in the ejection direction, the view showing that ink is being ejected using the print head.
Figure 5B:
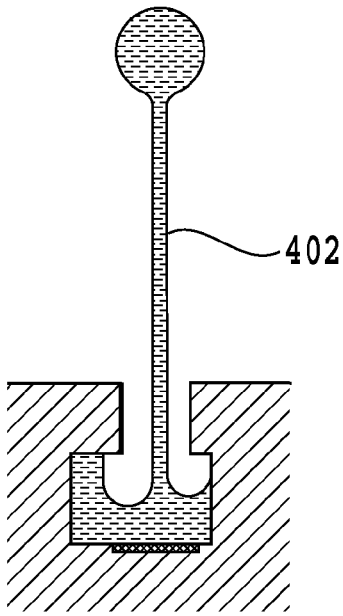
FIG. 5B is a sectional view taken along line VB-VB in FIG. 5A.
Figure 6A:
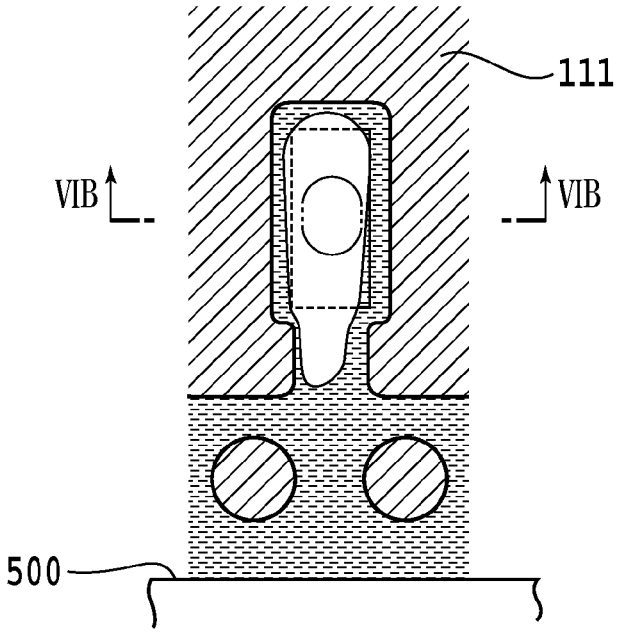
FIG. 6A is a sectional view showing the internal structure of a conventional print head in a comparative example as viewed in the ejection direction, the view showing that ink is being ejected using the print head.
Figure 6B:
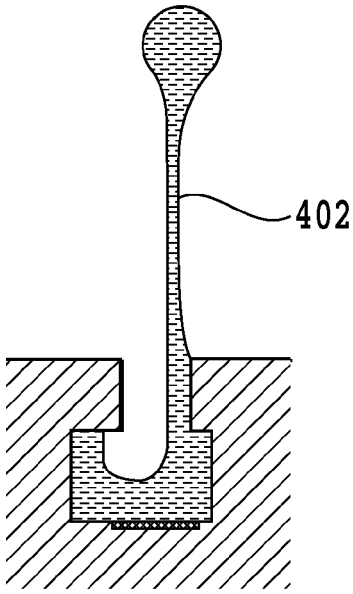
FIG. 6B is a sectional view taken along line VIB-VIB in FIG. 6A.

FIG. 5A is a sectional view of the print head according to the present embodiment as viewed in the ejection direction, showing that the ink is ejected from the print head. FIG. 5B is a sectional view taken along line VB-VB in FIG. 5A, showing that a droplet is being ejected. FIG. 6A is a sectional view of a print head in a comparative example to which the present invention is not applied, as viewed in the ejection direction, and shows that the ink is ejected from the print head. FIG. 6B is a sectional view taken along line VIB-VIB in FIG. 6A, showing that a droplet is being ejected.

In both print heads shown in FIGS. 5A and 5B and FIGS. 6A and 6B, the nozzle is formed such that the heater 400 and the channel forming member 111 are arranged offset with respect to each other for a certain reason related to the manufacturing process. That is, a print head formed as the center of the ejection port is offset from the center of the pressure chamber in the horizontal direction of the figures is shown in FIGS. 5B, 6B. FIGS. 5A and 6A also show a bubble 401 in a moment when the bubble 401 expanded to the maximum size under heat from the heater 400. FIGS. 5B and 6B show that the bubble generated has come into communication with the air with a trail 402 of the ejected bubble uncut.

As shown in FIGS. 5A, 5B, 6A, and 6B, the bubble 401 generated by the driven heater 400 also grows toward the ink supply port. In the conventional print head shown in FIGS. 6A and 6B, the distance between the heater 400 and the ink supply port 600 is relatively short. At this time, it is supposed that the center of the ejection port is offset from the center of the pressure chamber, as described above. In this case, a part of the bubble 401 which is closer to the ink supply port interferes with an inward projecting wall surface at the boundary between the pressure chamber 200 and the ink channel 600. Consequently, the bubble may come into contact with the wall surface. At this time, upon coming into contact with the wall surface of the pressure chamber 200, the bubble 401 is deformed into an asymmetric shape. If the bubble thus generated is asymmetric rather than being symmetric, the position of the bubble 401 is biased on the heater 400. The bubble may then fail to grow evenly in the ejection direction. If the bubble grows disproportionately, the ejected droplet is not ejected straight in the ejection direction as shown in FIG. 6B. This may reduce the droplet impact accuracy.

A fine droplet following the main droplet and called a satellite droplet may fly separately from the main droplet. If the trail of the droplet faces a direction different from the ejection direction, the satellite droplet is more likely to be generated. If droplets are disrupted and fine satellite droplets are generated and impact the print medium at a position different from the impact position of the main droplet, a quality of an image resulting from printing may be degraded. Furthermore, the satellite droplets may grow into flying mist, which may then adhere to the printing apparatus to contaminate the interior of the apparatus. Moreover, if the satellite droplets adhere to a measuring instrument such as an encoder for the carriage, the measuring instrument may disadvantageously become unable to make measurement.

In contrast, in the print head according to the present embodiment shown in FIGS. 5A and 5B, the heater 400 is located such that the center of the heater 400 along the ink supply direction is offset from the center of the pressure chamber 200 along the ink supply direction, toward the side of the pressure chamber 200 far from the ink supply port in the ink supply direction. Consequently, a relatively large space is created between the ink channel 600 and an area in the heater 400 which is closest to the ink supply port 500. Thus, in the print head that the center of the ejection port is offset from the center of the pressure chamber, even the grown bubble 401 is inhibited from coming into contact with the wall surface located at a near side to the ink supply port 500 of the pressure chamber 200. Therefore, during the growth of the bubble generated in order to eject the droplet, the bubble is prevented from being deformed. As a result, the droplet can be ejected with the bubble maintaining a symmetric shape inside the pressure chamber 200. The droplet is thus ejected straight in the predetermined direction. This prevents a possible decrease in droplet impact accuracy, thus allowing a high droplet impact accuracy to be maintained.

In the present embodiment, the heater 400 is located inside the pressure chamber 200 so as to have long sides along the ink supply direction of the nozzle 300 and short sides along the direction orthogonal to the ink supply direction. The short side of the heater 400 is at most half the long side thereof. If the heater 400 is square, the trail of the droplet is insignificantly bent. This prevents the degradation of quality of the image and possible mist. Furthermore, a smaller droplet ejection amount and a smaller ejection port have been found to more significantly affect the trail of the ejected droplet. Additionally, the offset between the heater 400 and the channel forming member 111 has been found to affect the ejected droplet even if the offset is at most 1 μm. It has been found that with the current manufacturing techniques for print heads, avoiding the above-described problems is very difficult.

Furthermore, the above-described problems have been found to particularly affect the trail of the ink during ejection if the heater 400 is rectangular and has long sides extending parallel to the ink supply direction as shown in FIGS. 4A, 4B, 5A, and 5B. In such a print head, if the heater 400 and the channel forming member 111 are arranged offset with respect to each other for a certain reason related to the manufacturing process, the trail is significantly bent.

Thus, in view of the accuracy of processing or assembly during manufacturing, the shape of the heater is preferably similar to a square rather than a rectangle. However, the number of pixels may need to be increased in order to obtain a high-quality image. Consequently, the ink jet printing apparatus may need to have a print head with an increased nozzle density. In this case, to allow an increase in the nozzle density of the print head, the pressure chamber is expected to be shaped like a rectangle having long sides along the ink supply direction, with the heater similarly shaped.

However, as described above, the offset between the heater and the channel forming member severely affects the print head in which the heater 400 is rectangular and is located such that the long sides thereof extend parallel to the ink supply direction. Thus, the present invention is effectively applicable to the print head in which the pressure chamber and the heater are each shaped like a rectangle having long sides along the ink supply direction.

As described above, in the print head IJH according to the present embodiment, the heater 400 is located such that the center of the heater 400 along the ink supply direction is offset from the center of the pressure chamber 200 along the ink supply direction as shown in FIG. 5A. Consequently, the generated and grown bubble 401 is inhibited from interfering with the inward projecting wall surface of the pressure chamber 200. Therefore, even during a vanishing process of the bubble, the bubble is kept symmetric. Even if the channel forming member 111 is joined offset as shown in FIG. 5B, the droplet is ejected straight in the predetermined direction. At this time, the trail of the ink droplet maybe slightly bent. However, the possible bending is less significant than that in the conventional nozzle. This allows the impact accuracy of the ejected droplet and the quality of the image resulting from printing to be kept high. Furthermore, the ejection direction of the satellite droplet follows that of the main droplet to allow the satellite droplet to fly straight ahead. The trailing 402 is prevented from being split. Additionally, if the trailing satellite droplet flies faster than the main droplet, the satellite droplet flies straight ahead to unite with the main droplet. This inhibits the satellite droplet from impacting the print medium at a position different from the impact position of the main droplet to degrade the quality of the printed image. The print head of the present embodiment also inhibits possible flying mist between the print head and the print medium.

Second Embodiment

Now, a second embodiment of the present invention will be described with reference to FIGS. 7A to 7C. Components of the second embodiment which can be configured as is the case with the first embodiment are denoted, in the figures, by the same reference numerals and will not be described below. Only differences from the first embodiment will be described below.

Figure 7C:
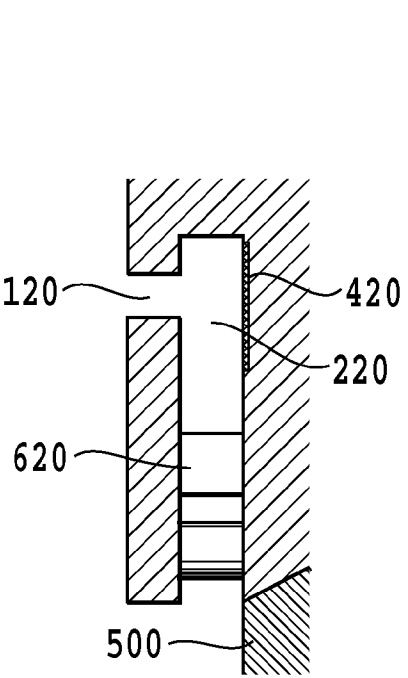
FIG. 7C is a sectional view taken along line VIIC-VIIC in FIG. 7A.
Figure 7B:
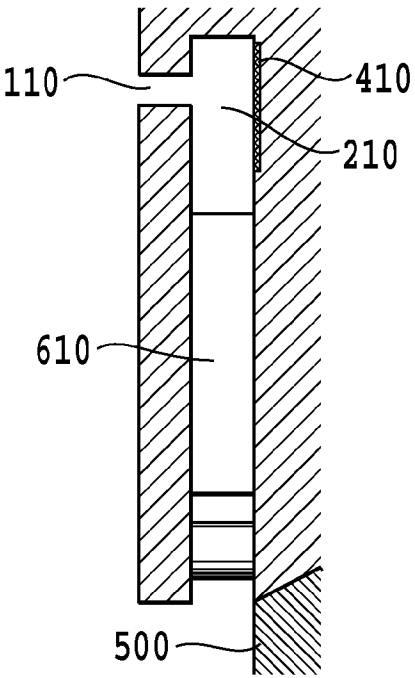
FIG. 7B is a sectional view taken along line VIIB-VIIB in FIG. 7A.
Figure 7A:
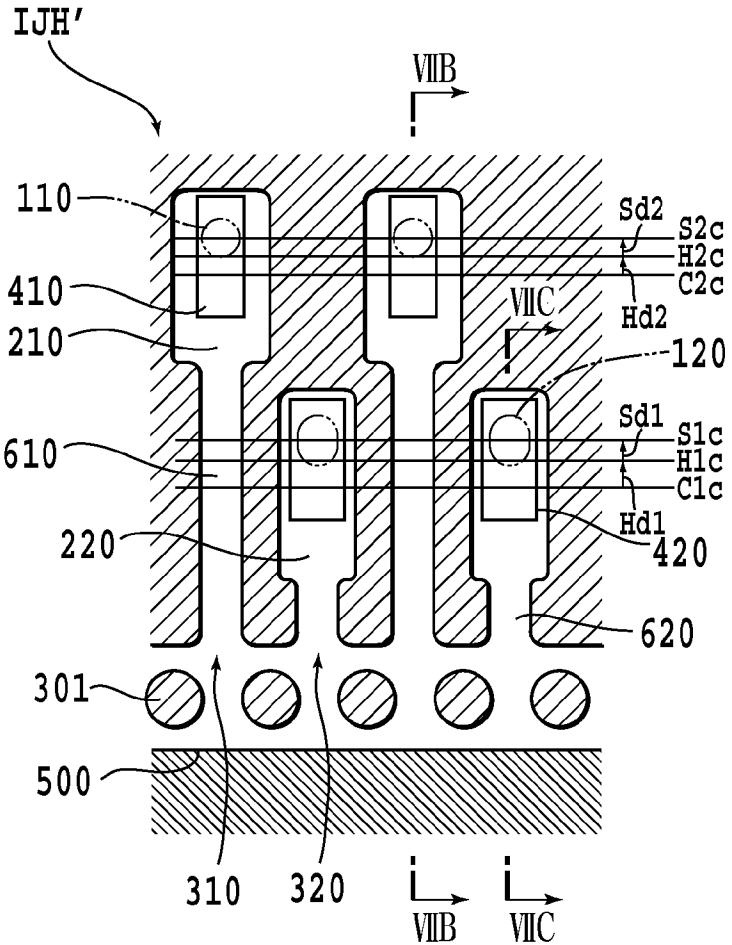
FIG. 7A is a sectional view showing an essential part of a print head according to a second embodiment of the present invention as viewed in the ejection direction, the view showing the internal structure of the print head.

FIGS. 7A to 7C show the nozzle structure of a print head IJH' according to the second embodiment of the present invention. FIG. 7A is a sectional view of the interior of four of a plurality of nozzles in the ink jet print head IJH' as viewed in the ink ejection direction. FIG. 7B is a sectional view taken along line VIIB-VIIB in FIG. 7A. FIG. 7C is a sectional view taken along line VIIC-VIIC in FIG. 7A.

The print head IJH' according to the second embodiment differs from the print head according to the first embodiment in that two types of a plurality of pressure chambers are staggeredly arranged on one side of an ink supply port 500 so as to lie at different distances from the ink supply port 500 in the direction orthogonal to the ink supply direction.

In FIGS. 7A to 7C, the pressure chamber has a first pressure chamber 210 and a second pressure chamber 220 formed at a shorter distance from the ink supply port 500 than the first pressure chamber 210. The area of a first heater 410 located in the first pressure chamber 210 and serving as a first print element is smaller than that of a second heater 420 located in the second pressure chamber 220 and serving as a second print element.

In the print head IJH' according to the present embodiment, the nozzle pitch in the direction in which the nozzle rows extend is 42.5 μm (600 dpi). The staggered nozzle rows allow the print head IJH' to offer a nozzle resolution of 1,200 dpi.

The first heater 410 in a nozzle (hereinafter referred to as a long nozzle) 310 located at a longer distance from the ink supply port 500 has a rectangular shape of 10×28.2 μm. The long nozzle 310 has the first pressure chamber 210, inside which the first heater 410 is located. The heater in a nozzle (hereinafter referred to as a short nozzle) 320 located at a shorter distance from the ink supply port 500 has a rectangular shape of 12×28 μm. The short nozzle 320 has the second pressure chamber 220, inside which the second heater 420 is located. Both heaters have an aspect ratio of at most 1/2 and are formed so that the length of the short side is at most half that of the long side.

The heater located in the pressure chamber 210, placed at the longer distance from the ink supply port 500, has a smaller area than that located in the pressure chamber placed at the shorter distance from the ink supply port 500. This is because the heater located further from the ink supply port 500 has a longer channel, and a flow resistance in the corresponding interval is higher. Thus, such a nozzle has a relatively long refill time. Also in the present embodiment, the centers of the heater and the ejection port are offset from the center of the pressure chamber. Consequently, the offset further increases the refill time. Thus, to allow a reduction in ink ejection amount and thus in refill time, the heater inside the pressure chamber located further from the ink supply port has a smaller area.

The height dimension of the nozzle is similar to that according to the first embodiment. The ejection port 110 of the long nozzle has a circular shape of diameter 9 μm and has an ejection amount of about 1 pl. The ejection port 120 of the short nozzle has an oval shape with a minor axis of 10 μm and a major axis of 12.5 μm and has an ejection amount of about 2 pl. The ejection port located further from the ink supply port has a smaller area than that located closer to the ink supply port. In this manner, the first ejection port formed in the first pressure chamber and the second ejection port formed in the second pressure chamber are formed such that the area of the first ejection port is smaller than that of the second ejection port. This is because a long refill time is required for the nozzle with the long ink channel leading to the interior of the pressure chamber because of the long distance between the ink supply port and the pressure chamber. Thus, the ejection amount is reduced to decrease the refill time, and the diameter of the long nozzle is reduced.

The diameter of any of the ejection ports is at most 15 μm.

The ink droplet ejected from the ejection port has a volume of less than 4 pl per ejection.

The first pressure chamber 200 in the long nozzle has a width of 22.5 μm in the direction in which the nozzle row extends and a length of 41.2 μm in the direction orthogonal to the direction in which the nozzle row extends. The distance between the first heater 400 and the wall located at the side of the first pressure chamber 200 far from ink supply port is about 2.5 μm. The distance between the ink supply port-side end of the heater and the ink supply port-side wall surface of the pressure chamber is 10.5 μm. The ink channel 610 is 10 μm in width and 67 μm in length.

In the long nozzle 310, the center C2*c* of the first pressure chamber 210 in the ink supply direction is offset from the center H2*c* of the first heater 410 in the ink supply direction by 3.8 μm. Thus, a relatively large space in which no heater is present and which is not associated with generation of bubbles is created near the ink channel for the first pressure chamber 210. Furthermore, in the present embodiment, the center H2*c* of the first heater 410 in the ink supply direction is offset from the center S2*c* of the ejection port by 5 μm to form an ejection port 110.

The second pressure chamber 220 as the short nozzle has a width of 19 μm along the nozzle row direction and a length of 45 μm along the ink supply direction. The clearance between the wall located at the side of the pressure chamber 220 far from the ink supply port and the second heater 420 and the clearance between the side walls of the pressure chamber 220 and the second heater 420 are both about 3.5 μm The clearance between the ink supply port-side end of the second heater 420 and the ink channel-side wall of the second pressure chamber 220 is 13.5 μm The ink channel 620 is 11 μm in width and 15.5 μm in length.

In the short nozzle 320, the center C1*c* of the second pressure chamber 220 in the ink supply direction is offset from the center H1*c* of the second heater 420 in the ink supply direction by 5 μm. Thus, a space in which the heater 420 is not present and which is not associated with generation of bubbles is created near the ink channel for the second pressure chamber 220. Furthermore, the center H1*c* of the second heater 420 in the ink supply direction is offset from the center S1*c* of the ejection port by 4.5 μm to form an ejection port 120.

In the present embodiment, the offset amount Hd1 between the center of the second pressure chamber and the center of the second heater in the short nozzle 320 with the large heater area is larger than the offset amount Hd2 in the long nozzle 310 with the small heater area. The offset amounts are preferably set to such appropriate values as prevent bubbles generated by the heaters from interfering with narrowed portions of the nozzle channels. In this case, an undue increase in offset amount increases time required for refilling. Thus, the nozzle configuration preferably involves the appropriate offset amounts depending on the size of the heaters and other conditions.

As a result, a plurality of pressure chambers are formed at different distances from the ink supply port. The heater in each of the pressure chambers has an area depending on the distance from the ink supply port to the pressure chamber. In the present embodiment, the area of the heater increases with decreasing distance from the ink supply port to the corresponding pressure chamber. The increased area of the heater increases the offset amount between the center of the heater along the ink supply direction and the center of the pressure chamber along the ink supply direction.

In the present embodiment, the ejection port is formed such that the center of the ejection port along the ink supply direction is offset from the center of the heater as a print element along the ink supply direction, toward the side of the pressure chamber far from the ink supply port. When the ink is ejected, part of the generated bubble located at the side far from the ink supply port pushes and ejects the stored ink from the ejection port. Thus, even if the generated bubble is deformed upon coming into contact with the ink supply port-side wall surface of the pressure chamber, the part of the bubble which is far from the deformed part pushes and ejects the ink. This inhibits the deformed bubble from affecting the ejection. Consequently, the ink pushed out by the deformed bubble is prevented from being ejected in a direction different from the predetermined ejection direction. The impact accuracy of the ejected ink is kept high.

Third Embodiment

Now, a print head IJH" according to a third embodiment of the present invention will be described with reference to FIGS. 8A to 8C. Components of the third embodiment which can be configured as is the case with the first and second embodiments are denoted, in the figures, by the same reference numerals and will not be described below. Only differences from the first and second embodiments will be described below.

Figure 8C:
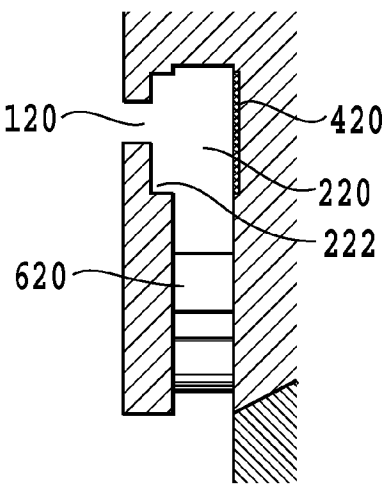
FIG. 8C is a sectional view taken along line VIIIC-VIIIC in FIG. 8A.
Figure 8B:
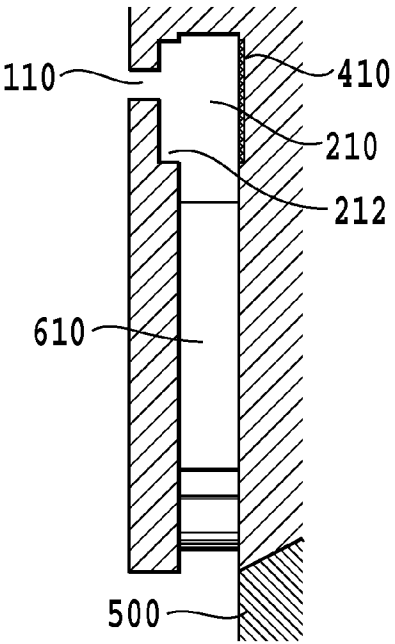
FIG. 8B is a sectional view taken along line VIIIB-VIIIB in FIG. 8A.
Figure 8A:
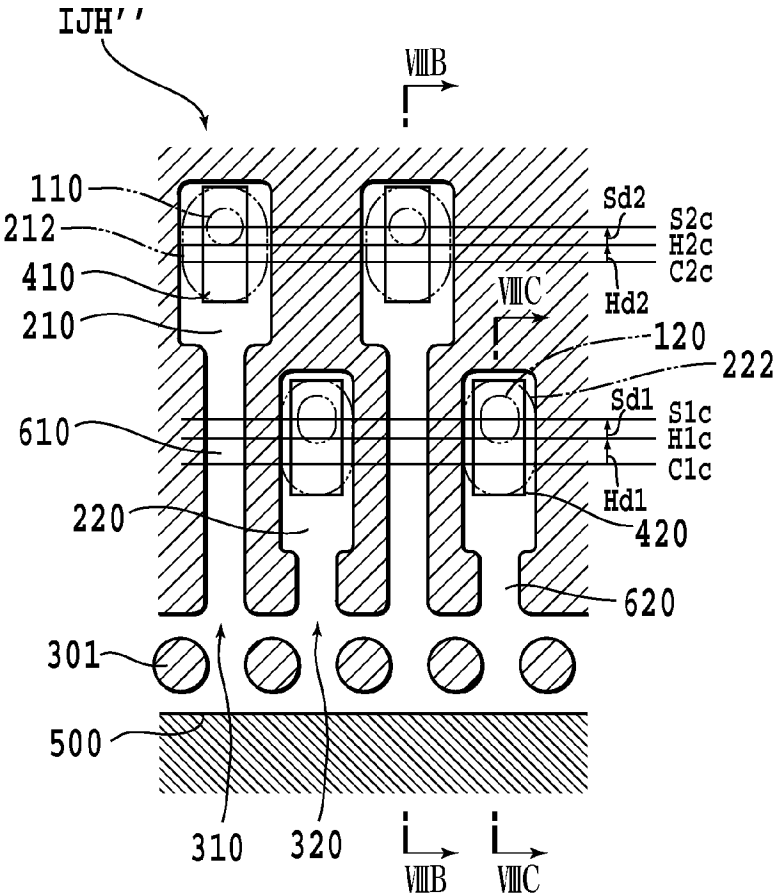
FIG. 8A is a sectional view showing an essential part of a print head according to a third embodiment of the present invention as viewed in the ejection direction, the view showing the internal structure of the print head.

FIGS. 8A to 8C show the nozzle structure of the ink jet print head according to the third embodiment of the present invention. FIG. 8A is a sectional view of an essential part of the print head IJH" as viewed in the ink ejection direction, the view showing the interior of the print head. FIG. 8B is a sectional view taken along line VIIIB-VIIIB in FIG. 8A. FIG. 8C is a sectional view taken along line VIIIC-VIIIC in FIG. 8A.

In the print head IJH" according to the third embodiment, a first pressure chamber has a main pressure chamber 210 in which a print element is located, and a sub pressure chamber 212 formed between the main pressure chamber and an ejection port. A second pressure chamber has a main pressure chamber 220 in which a print element is located, and a sub pressure chamber 222 formed between the main pressure chamber and an ejection port. In this regard, the print head IJH" according to the third embodiment is different from the print head IJH' according to the second embodiment. The sub pressure chambers 212 and 222 are formed in each of a first nozzle 310 located at a long distance from an ink supply port 500 and a second nozzle 320 located at a short distance from the ink supply port 500. The area of each of the sub pressure chambers 212 and 222 as viewed in the ejection direction in which a droplet is ejected is smaller than that of each of the main pressure chambers 210 and 220 as viewed in the ejection direction and larger than that of each of ejection ports 110 and 210 in the ejection direction. In the present embodiment, the sub pressure chambers 212 and 222 are formed to improve the efficiency with which the print head ejects ink.

In FIGS. 8A to 8C, the dimensions of the components other than the sub pressure chambers 212 and 222 according to the present embodiment are similar to those in the second embodiment shown in FIGS. 7A to 7C. The sub pressure chamber 212 in the long nozzle 310 has an oval shape with a minor axis of 19 μm and a major axis of 28.2 μm. The sub pressure chamber 222 in the short nozzle 320 has an oval shape with a minor axis of 16.5 μm and a major axis of 28 μm. The sub pressure chamber 212 in the long nozzle 310 and the sub pressure chamber 222 in the short nozzle 320 both have a height of 6 μm. The sub pressure chambers 212 and 222 formed in the long and short nozzles, respectively, reduce the height of the ejection port to 5 μm.

Fourth Embodiment

Now, a print head IJH"' according to a fourth embodiment of the present invention will be described with reference to FIGS. 9A to 9C. Components of the fourth embodiment which can be configured as is the case with the first to third embodiments are denoted, in the figures, by the same reference numerals and will not be described below. Only differences from the first to third embodiments will be described below.

Figure 9C:
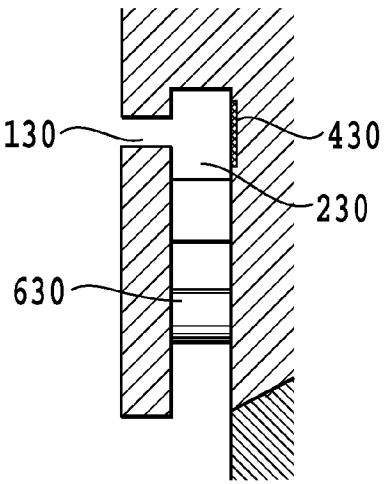
FIG. 9C is a sectional view taken along line IXC-IXC in FIG. 9A.
Figure 9B:
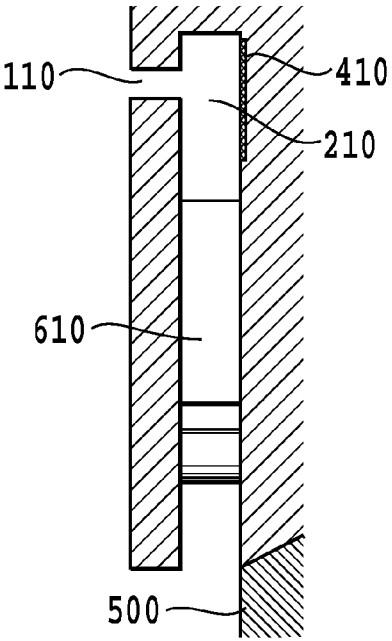
FIG. 9B is a sectional view taken along line IXB-IXB in FIG. 9A.
Figure 9A:
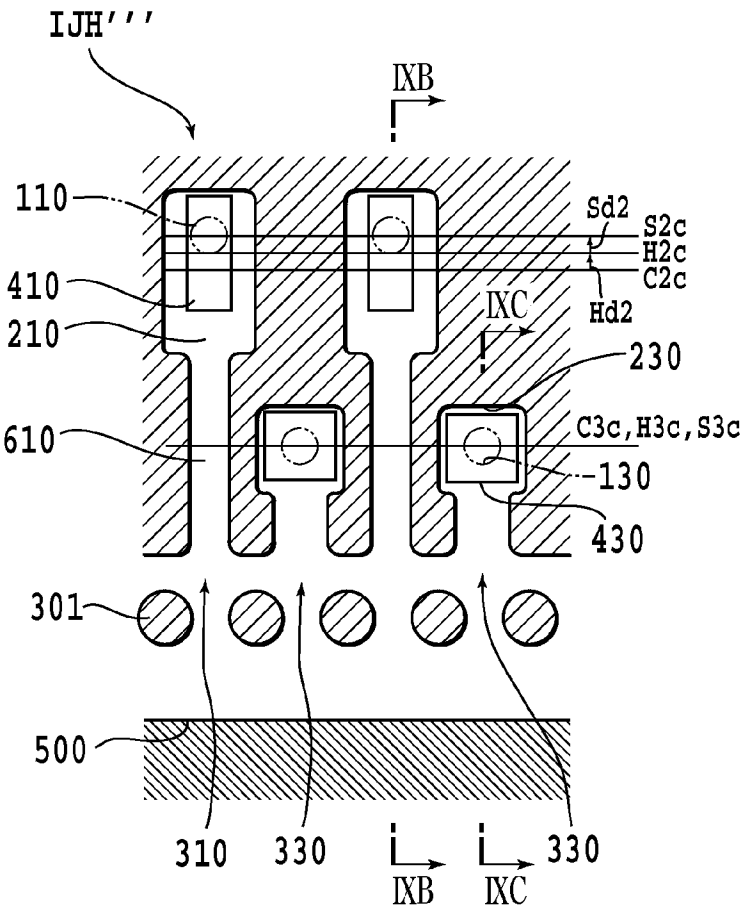
FIG. 9A is a sectional view showing an essential part of a print head according to a fourth embodiment of the present invention as viewed in the ejection direction, the view showing the internal structure of the print head.

FIG. 9A to 9C shows the nozzle structure of the ink jet print head according to the fourth embodiment of the present invention. FIG. 9A is a sectional view of an essential part of the print head as viewed in the ink ejection direction, the view showing the interior of the print head. FIG. 9B is a sectional view taken along line IXB-IXB in FIG. 9A. FIG. 9C is a sectional view taken along line IXC-IXC in FIG. 9A.

The print head according to the fourth embodiment differs from those according to the other embodiments in that a heater 430 located inside a pressure chamber 230 in a short nozzle 330 is square.

In the print head IJH''' shown in FIGS. 9A to 9C, for a long nozzle 310, the dimensions of the components are similar to those in the second embodiment. For the short nozzle 330, the heater 430 has a square shape of 17 μm×17 μm. An ejection port 130 has a circular shape with a diameter of 9 μm and has an ejection amount of about 1 pl. The pressure chamber 230 has a width of 21 μm in the nozzle row direction and a length of 21 μm in the ink supply direction. The clearance between the end of the heater 430 and the pressure chamber 230 is about 2.0 μm.

In the present embodiment, the square heater 430 is used for the short nozzle 330 to reduce the flow resistance of the ink in the short nozzle 330 as well as the refill time. Furthermore, the reduced flow resistance in the channel allows the ink to be efficiently collected to achieve acceptable recovery during a suction and recovery operation. The offset between the pressure chamber and the heater as in the above-described embodiments is applied to avoid possible problems with rectangular heaters. Thus, the center of the heater is offset from the center of the pressure chamber only in the nozzles with the rectangular heaters. In the short nozzle 330 according to the present embodiment, the pressure chamber 230 and the heater 430 are square. Thus, the above-described offset between the pressure chamber and the heater is not applied to the short nozzle 330. This also applies to the positional relationship between the ejection port and each of the pressure chamber and the heater. Thus, the center C2*c* of the pressure chamber 230 in the ink supply direction, the center H2*c* of the heater 430 in the ink supply direction, and the center S2*c* of the ejection port are all at the same position.

Fifth Embodiment

Now, a print head IJH'''' according to a fifth embodiment of the present invention will be described with reference to FIG. 10. Components of the fifth embodiment which can be configured as is the case with the first to fourth embodiments are denoted, in the figures, by the same reference numerals and will not be described below. Only differences from the first to fourth embodiments will be described below.

Figure 10:
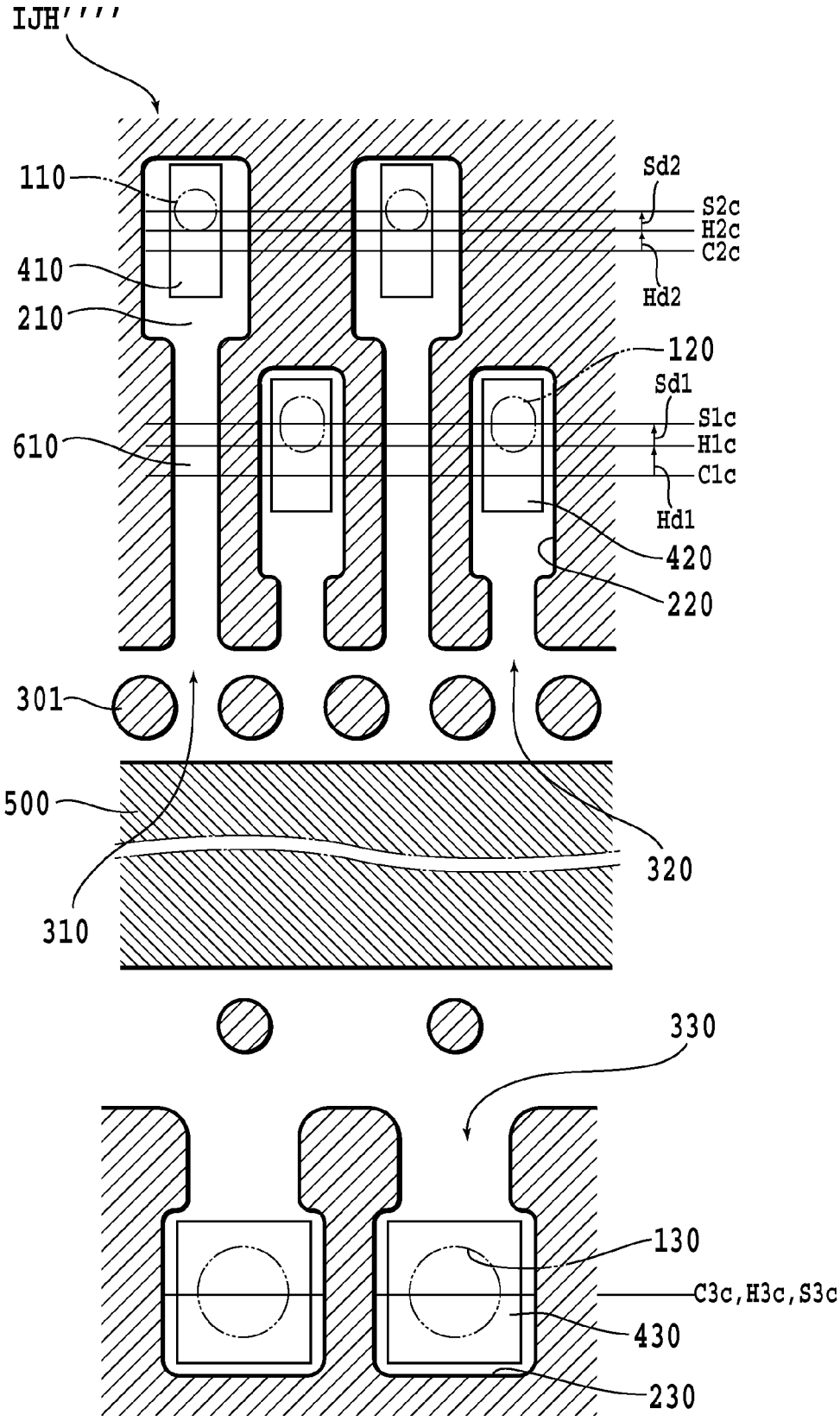
FIG. 10 is a sectional view showing an essential part of a print head according to a fifth embodiment of the present invention as viewed in the ejection direction, the view showing the internal structure of the print head.

FIG. 10 is a sectional view showing the nozzle structure of the print head IJH'''' according to the fifth embodiment of the present invention. FIG. 10 shows the interior of nozzles of an essential part in the print head IJH'''' as viewed in the ink ejection direction.

The print head IJH'''' according to the fifth embodiment differs from those according to the other embodiments in that the type of pressure chambers formed on one side of an ink supply port 500 is different from that of pressure chambers formed on the other side. On one side of the ink supply port 500, long nozzles 310 and short nozzles 320 are alternately formed so as to make up a nozzle row in which ejection ports 110 and 120 are staggeredly arranged as is the case with the second embodiment. On the other side of the ink supply port 500, nozzles 330 with a relatively large ejection amount are formed.

In FIG. 10, in the nozzle row in which the long nozzles 310 and the short nozzles 320 are alternately formed, the dimensions of the components are similar to those in the second embodiment. On the other hand, the opposite nozzles 330 have a nozzle pitch of 42.3 μm (600 dpi). Heaters 430 have a square shape of 26 μm×26 μm. In the nozzle row with the square heaters 430, ejection ports 130 have a circular shape with a diameter of 16.5 μm and has an ejection amount of about 5 pl. A pressure chamber 230 with the square heater 430 has a length of 30 μm in the ink supply direction and a width of 30 μm in the direction orthogonal to the ink supply direction. In the nozzle row having the square heaters, the center C3*c* of the pressure chamber 230 in the ink supply direction, the center H3*c* of the heater 430 in the ink supply direction, and the center S3*c* of the ejection port 130 are all at the same position.

In the pressure chamber 230 with the square heater 430 according to the present embodiment, the heater 430 and the pressure chamber 230 are not offset with respect to each other. The present configuration gives priority to the refill time and the suction and recovery capability.

Sixth Embodiment

Figure 11B:
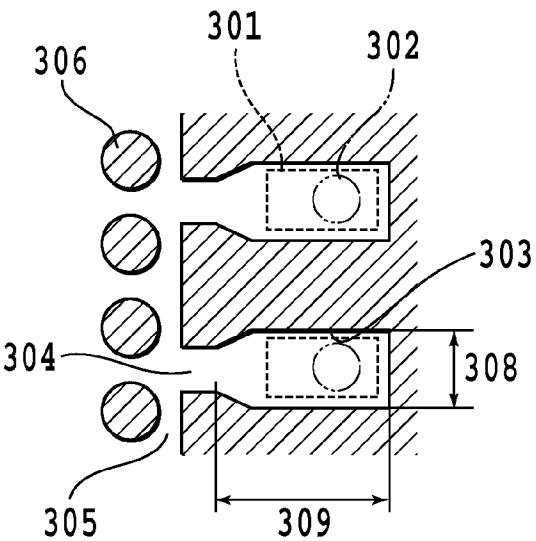
FIG. 11B is an enlarged sectional view of an essential part in FIG. 11A.

Now, a print head IJH''''' according to a sixth embodiment of the present invention will be described with reference to FIGS. 11A and 11B. Components of the sixth embodiment which can be configured as is the case with the first to fifth embodiments are denoted, in the figures, by the same reference numerals and will not be described below. Only differences from the first to fifth embodiments will be described below.

The print head according to the present embodiment differs from those according to the above-described embodiments in that a portion of an ink channel side of each pressure chamber formed on one side of an ink supply port 307 and having a rectangular heater 301 is partly tapered. In the nozzle in which each pressure chamber is partly tapered, a rectangular heater 301 is located inside a rectangular pressure chamber 303. The nozzle is formed such that the center of an ejection port 302 along the ink supply direction is offset from the center of the heater 301 along the ink supply direction.

Figure 11A:
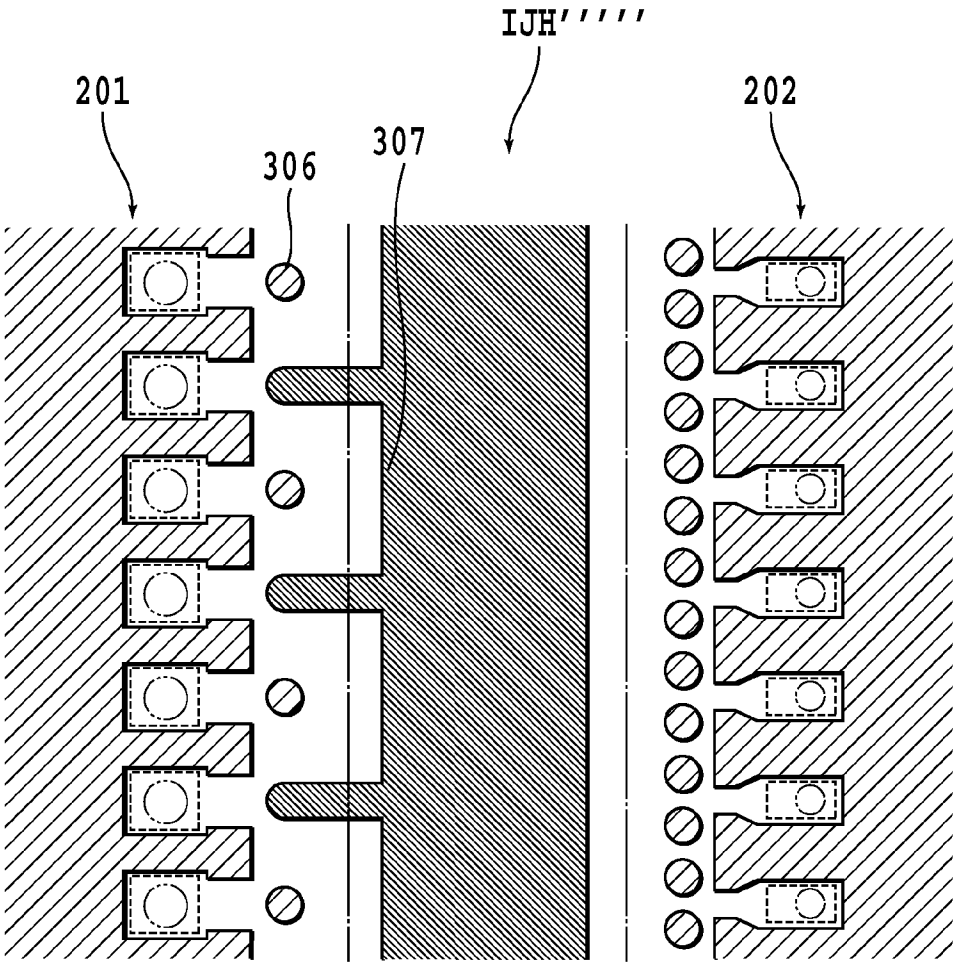
FIG. 11A is a sectional view showing an essential part of a print head according to a sixth embodiment of the present invention as viewed in the ejection direction, the view showing the internal structure of the print head

FIG. 11A is a sectional view of an essential part of the print head IJH''''' according to the present embodiment as viewed in the ink ejection direction, the view showing the interior of the print head IJH''''. FIG. 11B is an enlarged sectional view of the nozzle with the tapered ink channels. In the print head according to the present embodiment, as is the case with the fifth embodiment, pressure chambers with respective square heaters arranged therein are formed on one side of an ink supply port. Pressure chambers with respective rectangular heaters arranged therein are formed on the other side.

In the present embodiment, the nozzles with the square heaters are formed to eject 5 pl of ink droplet. The nozzle with the rectangular heaters is formed to eject 2 pl of ink droplet.

Now, the dimensions of the components of the nozzle will be described. In the print head according to the present embodiment, a nozzle row 201 having a relatively large ejection amount and which can eject 5 pl of ink droplet is formed on one side of the ink supply port 307. A nozzle row 202 having a relatively small ejection amount and which can eject 2 pl of ink droplet is formed on the other side. In this case, the size of the ink droplet ejected from each of the ink ejection ports provided in each nozzle row need not amount to 5 pl or 2 pl. The nozzle row has only to substantially correspond to about 5 pl or 2 pl.

Each ejection port 302 in the nozzle row 202 has an area enabling 2 pl of ink droplet to be ejected; the ejection port 302 has a circular shape of diameter 11.6 μm. The dimensions of the pressure chamber 303, an ink channel 304, and a heater 301 which communicate with the ejection port are adjusted to the amount of ink ejection of the ejection port 302. Specifically, the width of ink channel 304 is 10.5 μm. The heater 301 has a rectangular shape of 13.6×28 μm. The length 309 of the pressure chamber 303 is 43.5 μm. The width 308 of the pressure chamber 303 is 18.5 μm at an end thereof located opposite the ink supply port 307 and is 10.5 μm at the connection portion between the pressure chamber 303 and the ink channel 304 because of the taper. In the present embodiment, the center of the heater 301 is offset from the center of the pressure chamber 303. The offset amount is about 4,800 dpi. The ejection port 302 is formed offset with respect to the heater 301. Specifically, the ejection port 302 is located offset with respect to the heater 301 by 4 μm toward a side opposite to the ink supply port 307. The ink channel 304 is in communication with a common liquid chamber 305. A nozzle filter 306 is provided in the common liquid chamber 305. The nozzle filter 306 is formed of a cylinder of diameter 14 μm.

In the present embodiment, the ink channel is partly tapered so as to be wider from the ink supply port toward the pressure chamber. This arrangement reduces the flow resistance of the ink in the nozzle. This in turn increases the refill speed in the nozzle and allows the suction and recovery operation to be efficiently performed on the nozzle.

Seventh Embodiment

Figure 12:
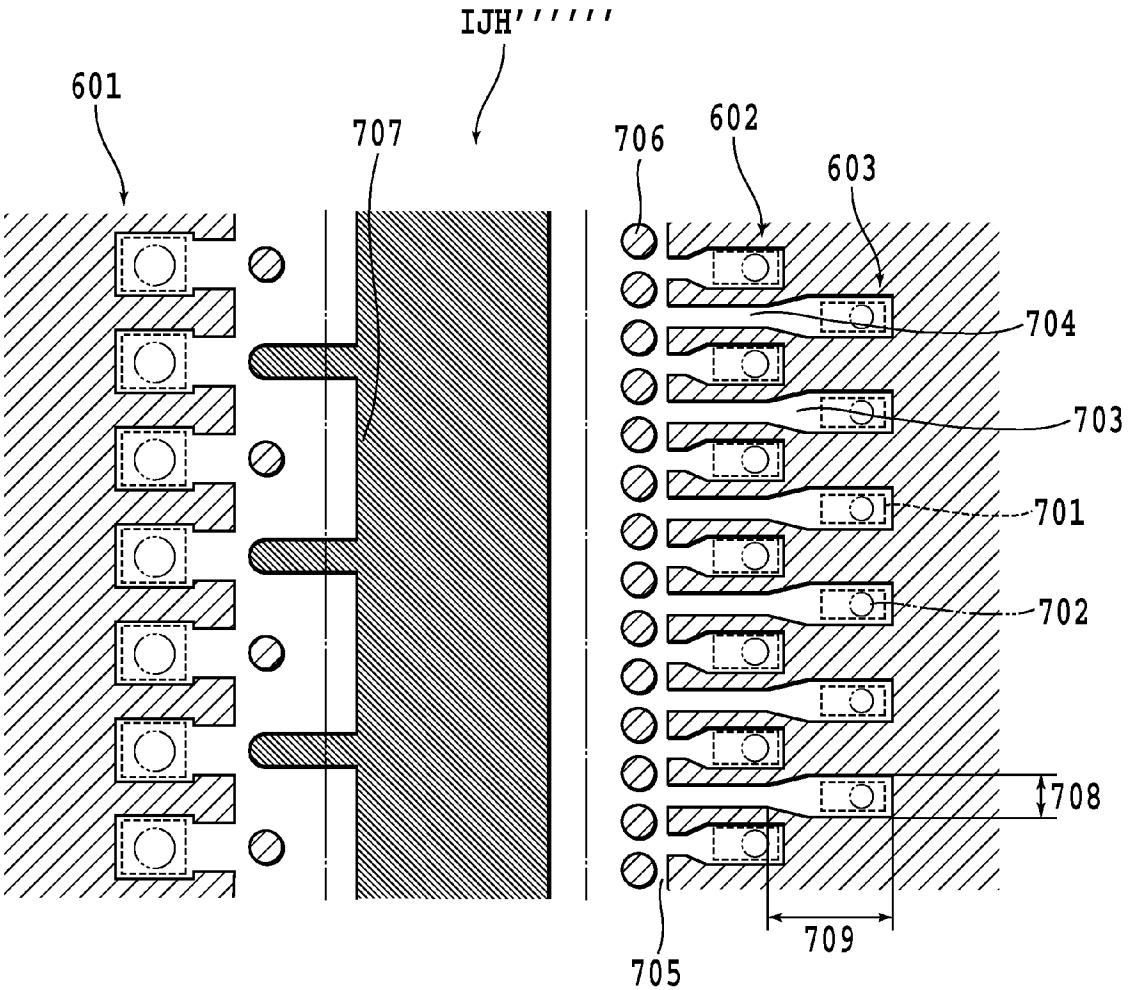
FIG. 12 is a sectional view showing an essential part of a print head according to a seventh embodiment of the present invention as viewed in the ejection direction, the view showing the internal structure of the print head.

Now, a print head IJH"""" according to a seventh embodiment of the present invention will be described with reference to FIG. 12. FIG. 12 is a plan view showing the print head IJH"""" according to the seventh embodiment. Components of the seventh embodiment which can be configured as is the case with the first to sixth embodiments are denoted, in the figures, by the same reference numerals and will not be described below. Only differences from the first to sixth embodiments will be described below.

In the seventh embodiment, as shown in the sixth embodiment, the ink supply port-side area of each pressure chamber in a nozzle row formed on one side of an ink supply port is partly tapered. The nozzle row is formed such that two types of nozzles with different distances from the ink supply port are alternately arranged and such that the nozzles are staggeredly arranged.

In the present embodiment, the print head has a nozzle row 601 that can eject 5 pl of ink droplet, a nozzle row 602 that can eject 2 pl of ink droplet, and a nozzle row 603 that can eject 1 pl of ink droplet. The shapes of the nozzles provided in the nozzle rows 601 and 602 are similar to those in the sixth embodiment. Each ink ejection port 702 provided in the nozzle row 603 has an area enabling 1 pl of ink droplet to be ejected; the ink ejection port 702 has a circular shape of diameter 9 μm. The dimensions of a heater 701, an ink channel 704, and a pressure chamber 703 which communicate with ejection port are adjusted to the amount of ink ejection of the ejection port 702. Specifically, the ink channel 704 is 10.5 μm in width. The heater 701 has a rectangular shape of 12.2×28 μm. The length 709 of the pressure chamber 703 along the ink supply direction is 54 μm. The width 708 of the pressure chamber 703 along the direction orthogonal to the ink supply direction is 18.5 μm at an end thereof located opposite the ink supply port 707 and is 10.5 μm at the connection portion between the pressure chamber 703 and the ink channel 704. That is, the channel in the part of the pressure chamber 703 is partly tapered so as to be narrower toward the ink supply port 707. The offset amount between the center of the pressure chamber 703 and the center of the heater 701 is about 2,400 dpi. In the present embodiment, the ejection port 702 is formed offset with respect to the heater 701 as is the case with the sixth embodiment. Specifically, the ejection port 702 is located offset with respect to the heater 701 by 4 μm toward a side opposite to the ink supply port 707. When the ink jet print head was actually used for printing, the quality of an image resulting from the printing is high even in a portion of the image corresponding to the nozzle row 603, from which 1 pl of ink droplet is ejected.

As described above, in the print head according to the present embodiment, the present invention can be applied to the relatively small nozzle row. Thus, the nozzle is configured to maintain the symmetry of bubbles generated during bubbling caused by the heater. Furthermore, relatively small ink droplets can be ejected. Thus, it has been found that the print head IJH"""" according to the present embodiment allows acceptable printing to be achieved even when fine ink droplets each with a volume of 1 pl or the like are ejected.

Other Embodiments

In the above-described embodiments, the shape of the pressure chamber is a substantial rectangle or square. However, when the space is created between the heater and the ink supply port-side wall surface of the pressure chamber according to the present invention, the growth of bubbles toward the channel does not depend on the shape of the pressure chamber. Thus, the shape of the pressure chamber is not limited to the rectangle or square. Furthermore, the ejection port is disclosed to be circular or oval. However, the shape of the ejection port may be like a rectangle or a star. That is, the shape of the ejection port is not limited to the circle or oval.

The "printing" as used herein is not limited to the formation of significant information such as texts or figures but may be used regardless of whether or not the printing target is significant. Furthermore, the "printing" represents the formation of a variety of images, patterns, or the like on a print medium, or the processing of the print medium, regardless of whether or not the result of the formation or processing is visually perceivable.

The "print medium" is not limited to paper, used for common printing apparatuses, but refers to a variety of materials that can receive ink, such as a cloth, a plastic film, a metal sheet, glass, ceramics, wood, and leather.

The "ink" (sometimes referred to as the "liquid") should be broadly interpreted as is the case with the definition of the printing. The "ink" represents a liquid applied to a print medium to form an image, a pattern, or the like thereon or to process the print medium or to process the ink (for example, to solidify or insolubilize a coloring material in the ink applied to the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-160365, filed Jun. 19, 2008 which is hereby incorporated by reference herein in its entirety.

What is claimed is:

1. A print head comprising:

ejection ports configured to eject liquid;

pressure chambers communicating with the ejection ports, the pressure chambers including a first pressure chamber and a second pressure chamber;

flow paths through which liquid flows from a liquid supply port to the pressure chambers, a width of each of the flow paths at a connecting portion where one of the pressure chambers and the flow path are connected is smaller than a width of the one of the pressure chambers at the connecting portion, the flow paths including a first flow path and a second flow path which is shorter than the first flow path; and print elements provided in each of the pressure chambers to generate energy for ejecting liquid from the ejection ports, a center of each of the print elements along a liquid supply direction from a corresponding one of the flow paths to a corresponding one of the pressure chambers is offset from a center of the corresponding one of the pressure chambers in the liquid supply direction, the print elements including a first print element provided in the first pressure chamber and a second print element provided in the second pressure chamber, wherein an offset amount between the centers of the first pressure chamber and the first print element in the first pressure chamber through which liquid flows from the first flow path is smaller than the offset amount between the centers of the second pressure chamber and the second print element in the second pressure chamber through which liquid flows from the second flow path.

2. The print head according to claim 1, wherein each of the print elements is provided in a corresponding one of the pressure chambers so as to form a long side along the liquid supply direction and a short side along a direction orthogonal to the liquid supply direction, and a length of the short side of each of the print elements is at most half that of the long side of the print element.

3. The print head according to claim 1, wherein each of the ejection ports is offset from a corresponding one of the print elements in the liquid supply direction.

4. The print head according to claim 1, wherein an area of the first print element provided in the first pressure chamber is smaller than that of the second print element provided in the second pressure chamber.

5. The print head according to claim 1, wherein an area of one of the ejection ports communicating with the first pressure chamber is smaller than that of another of the ejection ports communicating with the second pressure chamber.

* * * * *